US005134952A

United States Patent [19]

Doolittle

[11] Patent Number: 5,134,952

[45] Date of Patent: Aug. 4, 1992

[54] SAILBOARD OUTHAUL AND DOWNHAUL TENSIONING MECHANISM

[75] Inventor: William P. Doolittle, Seattle, Wash.

[73] Assignee: Neil Pryde Limited, Tuen Mun, Hong Kong

[21] Appl. No.: 438,510

[22] PCT Filed: May 24, 1988

[86] PCT No.: PCT/US88/01709

§ 371 Date: Nov. 21, 1989

§ 102(e) Date: Nov. 21, 1989

[87] PCT Pub. No.: WO88/09285

PCT Pub. Date: Dec. 1, 1988

Related U.S. Application Data

[63] Continuation-in-part of Ser. No. 54,475, May 26, 1987, abandoned.

[51] Int. Cl.[5] ..... B63B 35/82

[52] U.S. Cl. ..... 114/39.2; 114/90

[58] Field of Search ..... 114/102, 103, 89, 90, 114/93, 97, 109, 111, 108, 39.1, 39.2

[56] References Cited

FOREIGN PATENT DOCUMENTS

| | | | |
|---|---|---|---|
| 0163061 | 12/1985 | European Pat. Off. | 114/109 |
| 3326617 | 2/1985 | Fed. Rep. of Germany | 114/97 |
| 2551022 | 3/1985 | France | 114/97 |

*Primary Examiner*—Ed Swinehart

*Attorney, Agent, or Firm*—Christensen, O'Connor, Johnson & Kindness

[57] ABSTRACT

A fluid pressure member (26 or 26' or 100) is connected between foot portion (3) and upper portion (4) of the mast (3, 20, 4) of a sailboard (1) which, in turn, are connected to the head (6) and tack (10) of the sailboard sail (7). Controls for a source of fluid under pressure (32 or 50) for the pressure member (26 or 26' or 100) are mounted on the boom (5) for convenient access by the user. While under sail, the user can cause a portion (29 or 101) of the fluid pressure member to extend and retract to adjust the overall effective height of the mast (3, 20, 4) and, consequently, the tension of the downhaul (11), i.e., the vertical tension applied to the leading upright edge of the sail (7). A similar fluid pressure member (76) can be carried in the boom (5) to adjust the tension of the outhaul (9).

13 Claims, 5 Drawing Sheets

SAILBOARD OUTHAUL AND DOWNHAUL TENSIONING MECHANISM

This application is a continuation-in-part of application Ser. No. 07/054,475, filed May 26, 1987, abandoned.

TECHNICAL FIELD

The present invention relates to an improvement for a sailboard. More specifically, the present invention relates to a sailboard having mechanism actuatable by the user while under sail to adjust the downhaul tension and/or outhaul tension to achieve a desired change in the shape of the sail airfoil.

BACKGROUND ART

In known sailboard constructions a generally horizontal, aftward-extending boom is lashed to the upright mast. The head of the generally triangular fore-and-aft sail is connected to the tip of the mast such as by a pocket of the sail head being fitted over the mast tip. The clew of the sail is connected to the aft end of the boom by the outhaul. The tack of the sail is connected to the foot of the boom by the downhaul. Sometimes the connection of the head of the sail to the mast can be adjusted during rigging to accommodate masts of different heights. Prior to sailing, the outhaul tension and the downhaul tension are set. None of these adjustments is altered during sailing.

Sophisticated and expensive sailboard sails have been designed to change shape in differing wind conditions. For example, different sail materials can be used in different parts of the sail to stretch differently depending on wind direction and strength. In addition, sailboard sails have been designed to take advantage of the inevitable structural changes due to dynamic loading while sailing, such as changes in mast curvature. Still, the shape of the sail airfoil has been predetermined at the time of rigging and there is no known mechanism permitting changes while under sail.

DISCLOSURE OF THE INVENTION

In accordance with the present invention, a first fluid pressure member is mounted inside the foot portion of the mast of a sailboard and a second fluid pressure member is mounted in the aft end portion of the boom. The first fluid pressure member is actuatable to extend or retract the mast. Since the head of the sail is fixed to the tip of the mast and the tack of the sail is connected to the foot, the result of extending the mast is to increase the downhaul tension, whereas the result of retracting the mast is to decrease the downhaul tension. The fluid pressure member can be a jack with a reciprocating plunger or an extensible bellows member connected between telescoping, relatively slidable mast portions. The second fluid pressure member preferably is anchored to the boom with a reciprocating member or portion connected directly to the outhaul to tighten or loosen it by introducing or exhausting fluid from such second fluid pressure member. Manual controls for the separate fluid pressure members are conveniently mounted on the boom for access by the user while under sail. The change in downhaul and/or outhaul tension effects a change in the shape of the sail to adapt it for changing wind conditions or runs in different directions relative to the wind.

The mechanism in accordance with the invention is compact, of simple construction and easy to use, yet reliable over a long period and easily adaptable to sailboards, sails and rigging systems of different manufacturers.

BEST MODE FOR CARRYING OUT THE INVENTION

Figure 1:
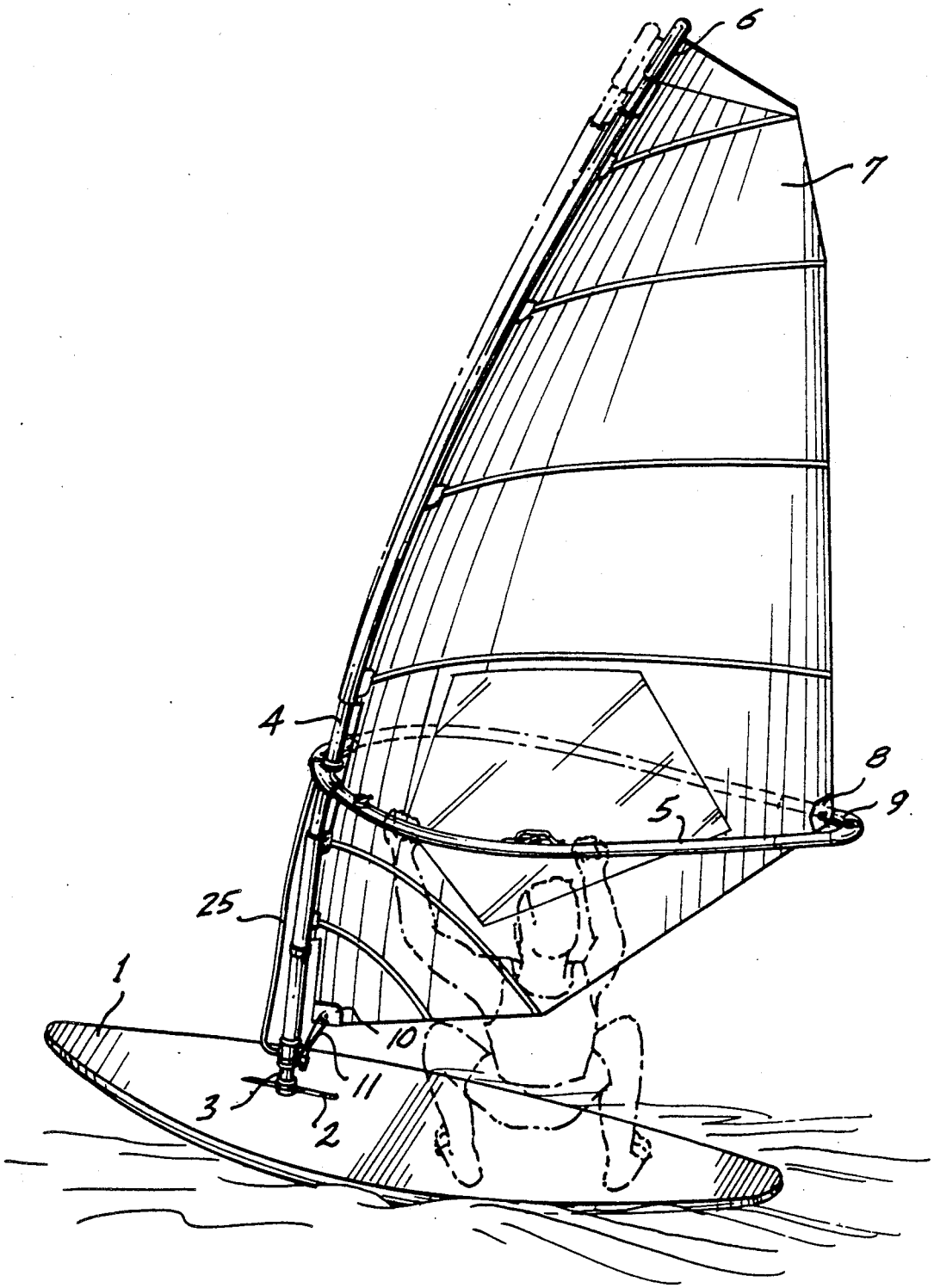
FIG. 1 is a diagrammatic top perspective of a sailboard having a first embodiment of downhaul tensioning mechanism in accordance with the present invention.

With reference to FIG. 1, many of the components used with the first embodiment of sailboard downhaul tensioning mechanism in accordance with the present invention are conventional. The board 1 has a track or keyway 2 for the foot 3 of the upright mast 4. The leading end portion of the ovate boom 5 is lashed to the mast. The head 6 of the sail 7 is connected to the tip of the mast such as by a pocket of the sail head being fitted over the tip of the mast. The clew 8 is connected to the rear end portion of the boom by the outhaul 9. The tack 10 is connected to the mast foot by the downhaul 11.

In accordance with the present invention, the long upper section 4 of the mast is adjustable up and down relative to the foot 3 so as to adjust the tension of the downhaul 11. Increasing or decreasing the downhaul tension has a dramatic effect on the shape of the sail airfoil. For example, increasing the downhaul tension by extending the upper portion of the mast increases the rearward bend of the mast, flattens the airfoil shape of the sail and moves the line of action of the sail airfoil and, consequently, the center of pressure forward, all of which may be desirable to increase speed in high winds or on upwind runs. Correspondingly, in low winds or on downwind runs, it may be desirable to decrease downhaul tension, thereby increasing the curvature or pocket of the sail airfoil.

Figure 2:
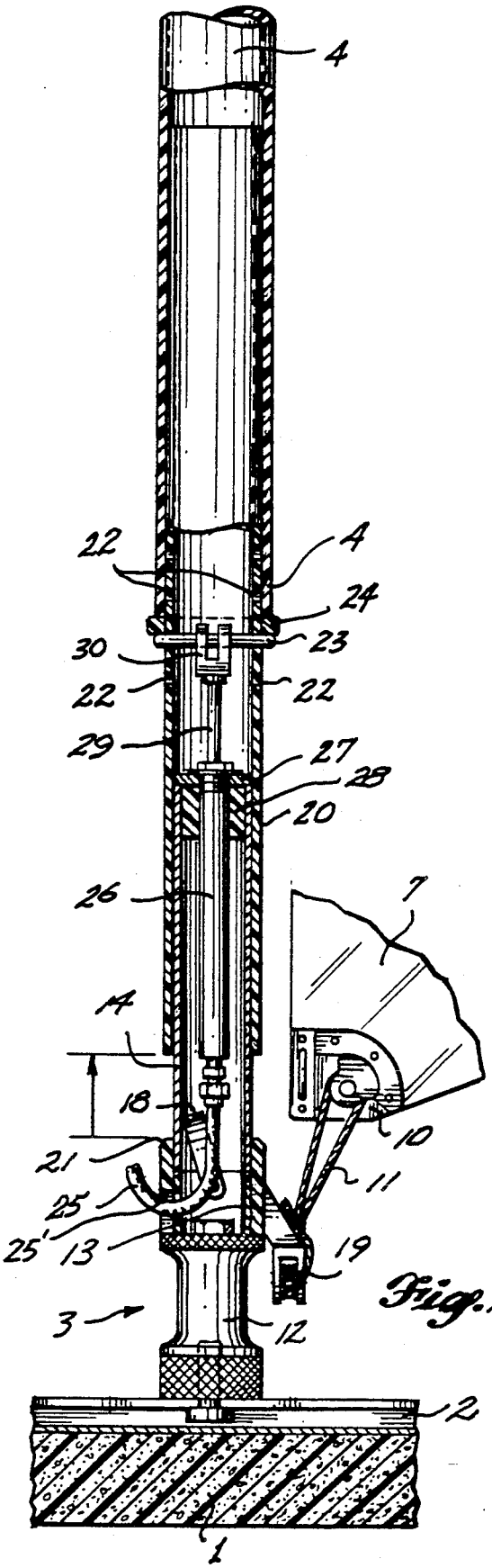
FIG. 2 is a fragmentary side elevation of the foot portion of the mast of the sailboard of FIG. 1, and the adjacent structure, with parts broken away.
Figure 3:
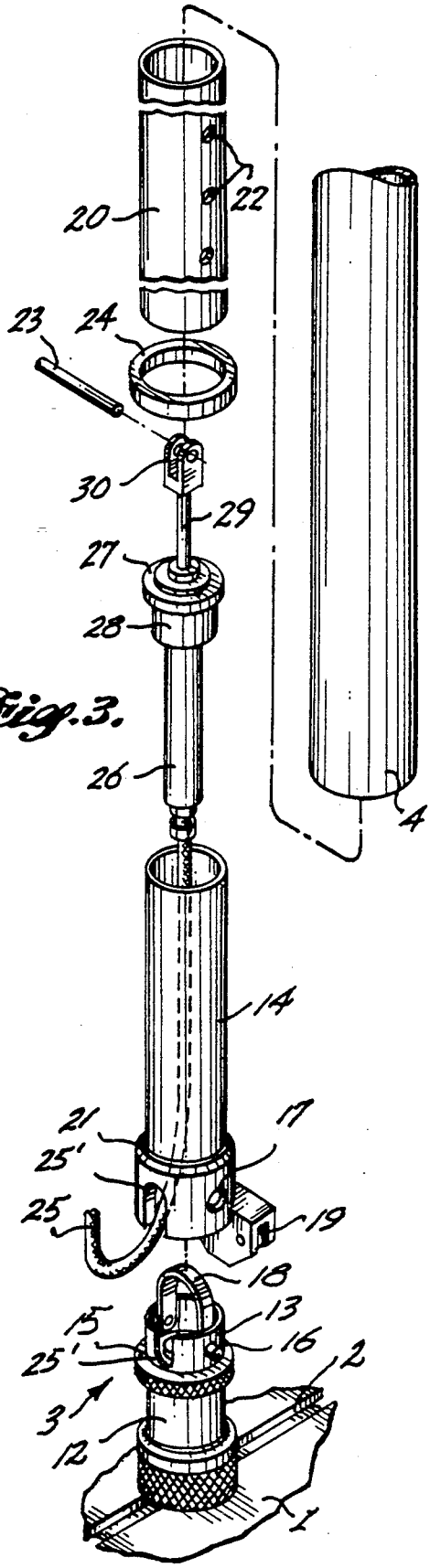
FIG. 3 is a fragmentary top perspective of essentially the same structure with parts shown in exploded relationship.

The modified construction of the lower portion of the mast is best seen in FIGS. 2 and 3. The composite foot 3 includes a standard base or flex mount 12 secured in the track 2 and having an upper cylindrical portion 13 over which the bottom portion of an inner mast-mounting tube 14 is fitted. Such pieces are held in position with the bottom of the tube 14 resting on a shoulder 15 of the flex mount by a pin 16 extending through a hole 17 of tube 14, seen in FIG. 3, and a registered hole through the flex mount cylindrical portion 13. Such pin is biased resiliently outward by a return bent leaf spring 18. The foot pulley 19 for the downhaul 11 is stationarily mounted on the lower end portion of the mounting tube 14.

As is conventional in some known sailboard constructions, an intermediate mast height adjustment tube 20 is fitted over the inner mounting tube 14 of the foot. In the conventional construction, such tube 20 would slide down to the shoulder 21 toward the bottom of tube 14. The intermediate adjustment tube extends a substantial distance above the top of tube 14 and has vertically spaced pairs of diametrally aligned holes 22 for a positioning pin 23. Such pin can support a cylindrical collar 24 which, in turn, supports the outer long upper mast tube section 4 telescoped over the upper end portion of the adjustment tube 20. At the time of rigging the sailboard, the set of holes 22 in which the pin 23 is fitted is selected depending on the overall height and cut of the sail.

In accordance with the present invention, registered slots 25' are formed in the upper cylindrical portion 13 of the flex mount 12 and the lower portion of the inner mast-mounting tube 14 for the fluid supply line 25 to an internal fluid pressure jack 26. The upper end portion of the jack can be carried by a mounting disk 27 of approximately the same external diameter as the tube 14, thereby limiting downward movement of the jack relative to the mounting tube. A bushing 28 encircling the upper end portion of the jack below the disk 27 positions the jack substantially axially of the mounting tube 14 and the mast 4 with the reciprocable jack plunger 29 extending upward to a clevis 30. The clevis has registered holes receiving the central portion of the mast-positioning pin 23 inside the adjustment tube 20.

Supplying fluid under pressure to the jack 26 through supply line 25 causes the jack plunger 29 to extend, thereby raising the intermediate adjustment tube 20 relative to the mast foot 3 and carrying with it the long upper mast section 4. In the position shown in FIG. 2, for example, the bottom of the adjustment tube has been lifted from the shoulder 21 which would otherwise support it. Releasing fluid from the jack through the supply line causes the plunger to retract such that the intermediate adjustment tube 20 and mast 4 slide downward relative to the foot 3 which carries the stationary downhaul pulley 19.

Figure 4:
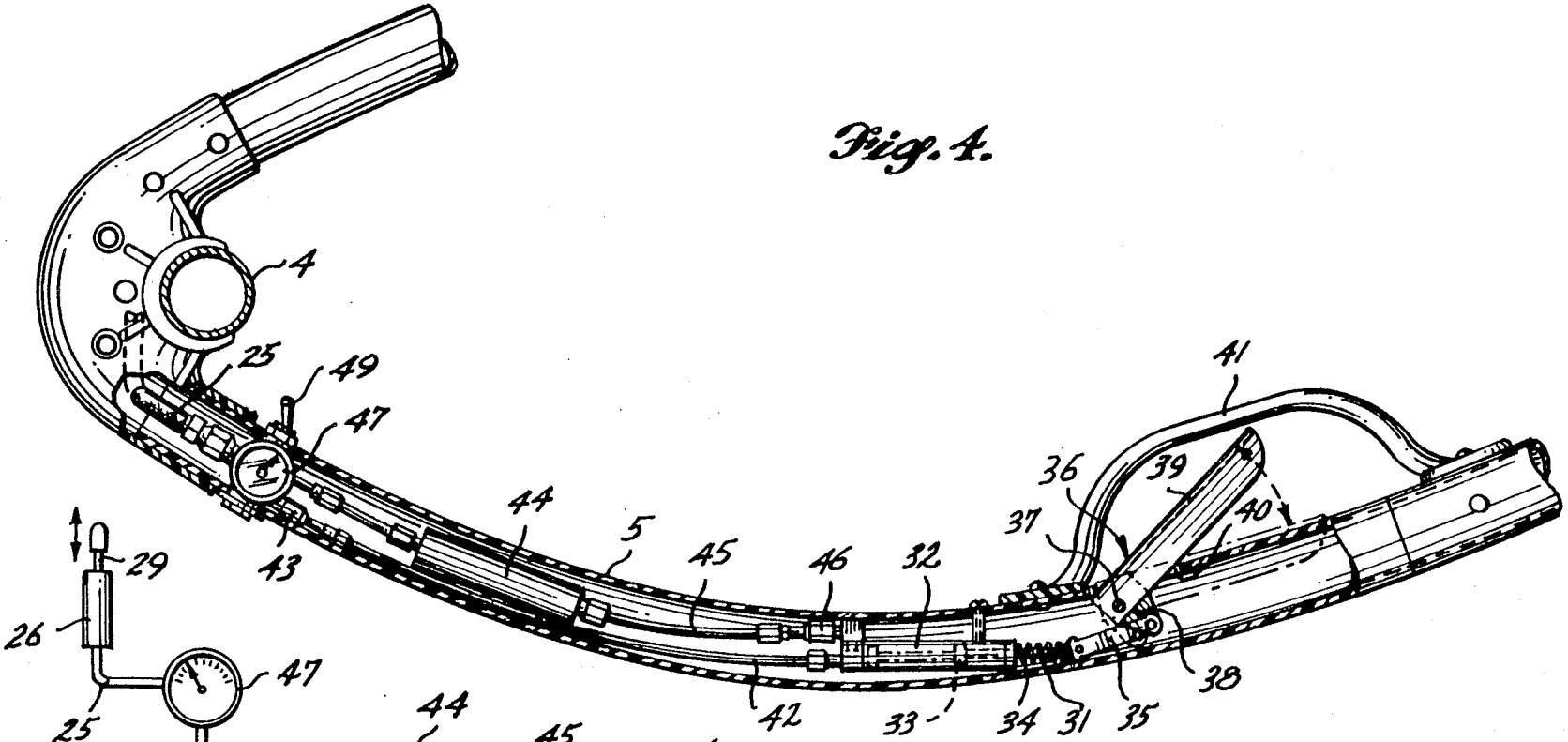
FIG. 4 is a fragmentary top plan of the boom of the sailboard of FIG. 1 with parts broken away to illustrate other components of the first embodiment of downhaul tensioning mechanism in accordance with the present invention.
Figure 5:
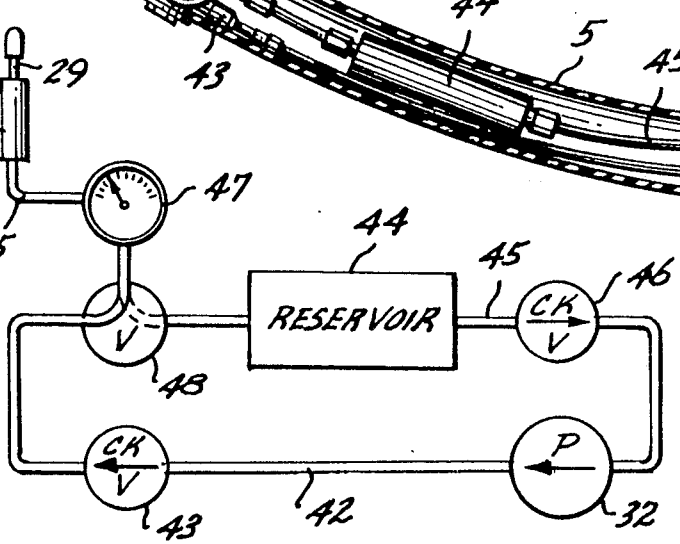
FIG. 5 is a schematic fluid circuit diagram of the first form of downhaul tensioning mechanism in accordance with the present invention.

For convenient operation while under sail, the controls for supply of fluid under pressure to the jack can be mounted on the hand-held boom 5, as seen in FIG. 4. The fluid circuit diagram is shown schematically in FIG. 5. A simple, manually operated pump 32 is mounted inside the tubular boom 5 and has an internal piston 33 carried by a piston rod 34. The free end of rod 34 is pivotally connected to the front end portion of an internal link 35 extending generally longitudinally of the boom. The rear end portion of the link is pivotally connected to an actuating lever 36 in the form of a bell crank. Lever or crank 36 is mounted for swinging about the upright axis of a pin 37 stationary relative to the boom 5. The short inward-projecting leg 38 of the actuating lever 36 is the portion connected to the link 35, whereas the long rearward-projecting leg 39 extends out through a slot 40 in the inner side of the boom for access by the user. The outward-extending portion of the actuating lever 36 preferably is enclosed by a guard 41 to prevent inadvertent actuation or pinching of the user's hand.

In the first embodiment of the invention, hydraulic liquid is the operating fluid. Inward movement of the lever arm 39 moves the piston forward to eject hydraulic liquid into a line 42. When the lever is released, the force of a helical compression spring 31 encircling the outer portion of rod 34 moves lever 36 back to the position shown in FIG. 4. A check valve 43 prevents return of liquid back into the pump when the lever moves back outward so as to retract the internal piston 33. Such retraction of the piston sucks liquid from a reservoir 44 through another line 45 and another check valve 46 back into the pump such that when the lever arm 39 is again moved inward, additional liquid is expelled from the pump through line 42 and check valve 43 into the jack liquid supply line 25. As seen in FIG. 1, supply line 25 extends downward along the leading edge of the mast. Returning to FIGS. 4 and 5, the downhaul tension can be gauged by the pressure of liquid in the jack which can be read from an external gauge 47 mounted on the boom.

When it is desired to retract the mast, a manually operable valve 48 can be actuated to allow flow of liquid from the jack back to the reservoir 44. The actuated position of the valve is shown in broken lines in FIG. 5. In the illustrated embodiment the valve is moved between its solid and broken line positions by a simple switch 49 which can be positioned on the boom as seen in FIG. 4 for convenient access by the user while under sail.

Figures 6, 10:
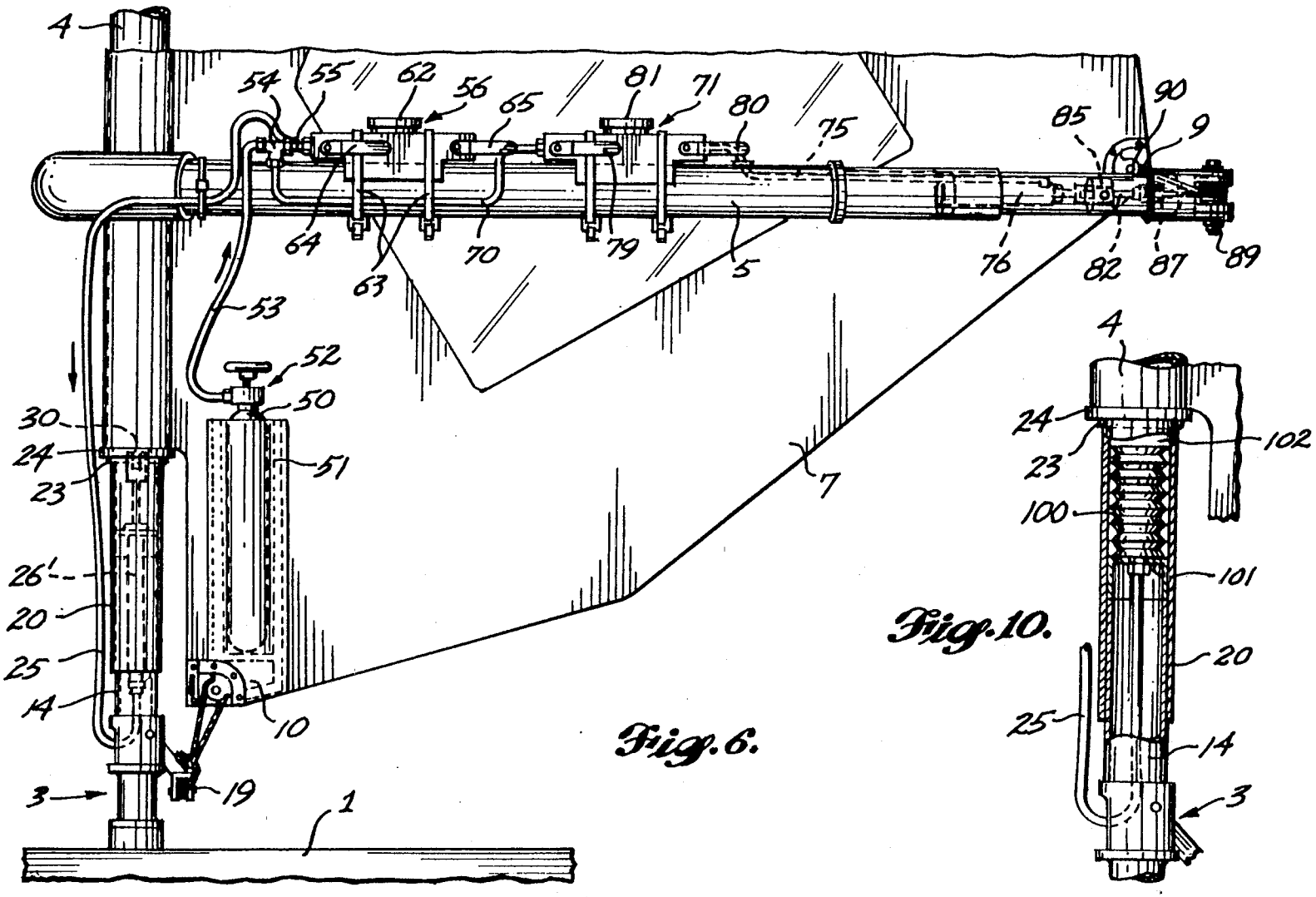
FIG. 6 is a somewhat diagrammatic, fragmentary, side elevation of the preferred embodiment of downhaul and outhaul tensioning mechanism in accordance with the present invention.
FIG. 10 (on the drawing sheet with FIG. 6) is a fragmentary side elevation of a further embodiment of downhaul tensioning mechanism with parts broken away.
Figures 7, 8, 9:
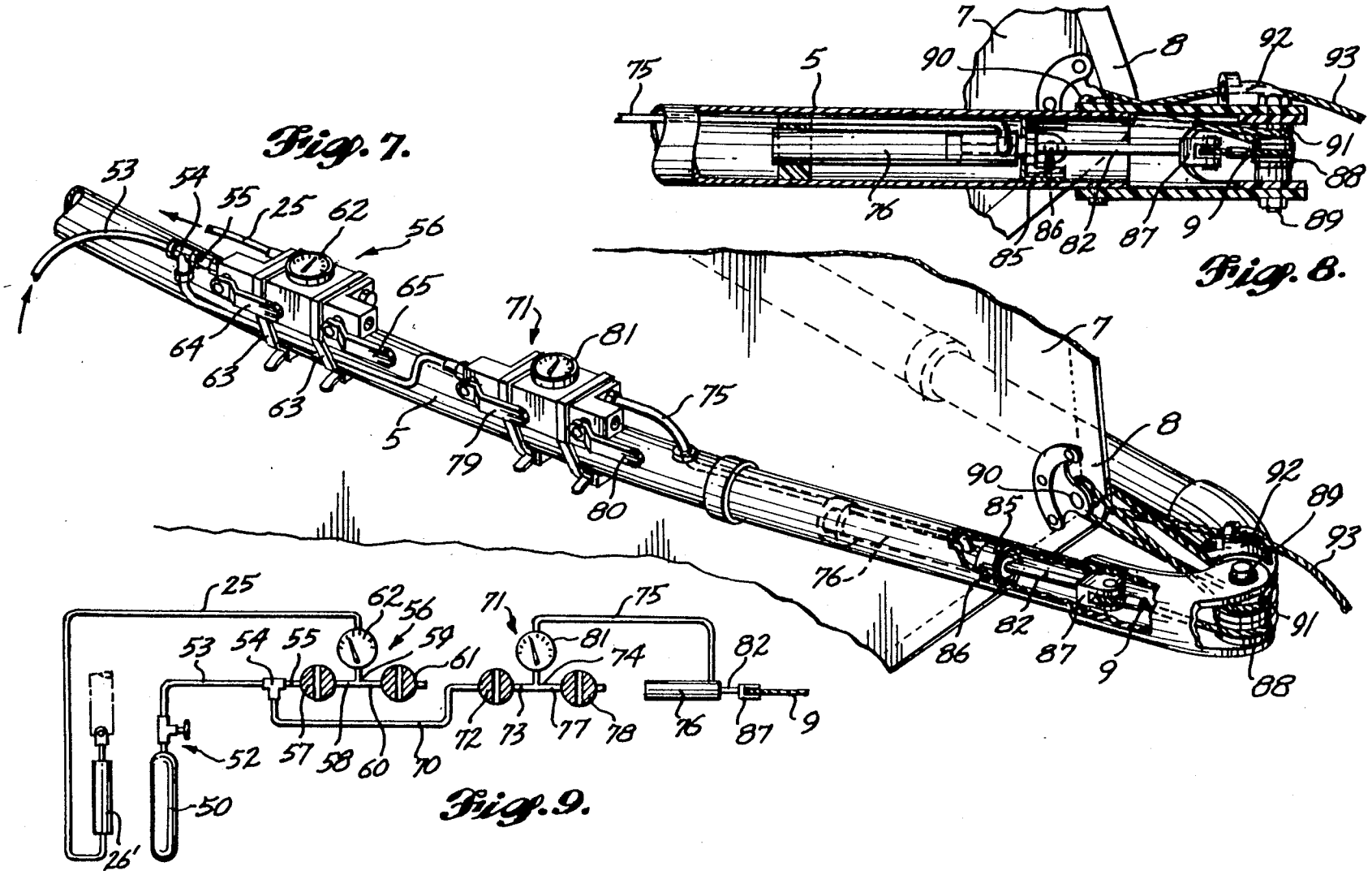
FIG. 7 is a fragmentary top perspective of components of such preferred embodiment, particularly operating components of the outhaul tensioning mechanism, with parts broken away.
FIG. 8 is an enlarged fragmentary side elevation of components of such preferred form of outhaul tensioning mechanism with parts broken away.
FIG. 9 is a schematic fluid circuit diagram of such preferred form of downhaul and outhaul tensioning mechanism in accordance with the present invention.

In the preferred embodiment of the present invention shown in FIGS. 6 through 9, mechanism is provided for adjusting both the downhaul tension and the outhaul tension. The downhaul tensioning mechanism is quite similar to the mechanism in accordance with the first embodiment of the invention. With reference to FIG. 6, the construction of the board 1, foot 3 with its downhaul pulley 19, mast-mounting tube 14, intermediate mast-height adjustment tube 20, the long top mast section 4 telescoped downward over tube 20 and resting on the collar 24 supported on the diametral pin 23 which, in turn, is carried in the clevis 30 of the jack 26' all are the same as in the first described embodiment. In the case of the preferred embodiment shown in FIGS. 6 through 9, however, jack 26' is a pneumatic jack and, rather than using a pump and reservoir system for supplying fluid under pressure through the supply line 25, the compressed gas source is a bottle or cylinder 50 which can be carried in a pocket 51 adjacent to the tack portion 10 of the sail 7. Such bottle has a conventional shutoff valve 52 which would normally be open so that the gas-containing interior of the bottle 50 is in communication with the outlet line 53 extending upward toward the boom 5. With reference to FIG. 9 illustrating the fluid circuit diagram, line 53 extends to a tee 54 having one branch 55 leading to a first valve and pressure gauge assembly 56. Such assembly has an inlet ball valve 57 which, when opened, allows gas to flow through line 58 to a tee 59 in communication with the fluid supply line 25 leading to jack 26'. The other branch 60 from tee 59 leads to an outlet or exhaust ball valve 61 which, with valve 57 closed, can be opened to exhaust gas from the cylinder 26' and thereby lower the boom. The downhaul tension can be gauged by the pressure of gas in line 25 which can be read from an external gauge 62 supplied as part of the valve assembly 56.

As seen in FIGS. 6 and 7, preferably the first valve assembly 56 is conveniently mounted on the boom for easy access by the user and easy reading of the pressure gauge 62. The valve assembly can be secured to the boom by conventional cable ties 63 and can have conveniently located operating levers 64 and 65 for the internal inlet and outlet ball valves, respectively. From the closed position indicated in FIGS. 6 and 7, lever 64 can be turned to open its valve, thereby causing gas to flow into the pneumatic jack until a desired tensioning of the downhaul has been achieved, whereupon the valve lever 64 is turned back to its closed position. When it is desired to decrease the downhaul tension, operating lever 65 can be turned to open its ball valve and exhaust compressed gas from the pneumatic jack.

With reference to FIG. 9, the outlet line 53 from the bottle 50 branches at tee 54 to a second inlet line 70 for a second valve assembly 71 substantially the same as the first valve assembly 56. Such inlet line 70 is in communication with the interior of the bottle 50 and leads to a first ball valve 72 feeding a line 73 leading to a tee 74. From line 73, tee 74 has a first branch 75 leading to a second pneumatic cylinder 76 and a second branch 77 leading to an outlet or exhaust ball valve 78.

As best seen in FIG. 7, the second valve assembly 71 can be mounted on the boom 5 adjacent to the first valve assembly 56 and have manually operated levers 79 and 80 for opening and closing the internal inlet and exhaust ball valves. Valve assembly 71 also has an external pressure gauge 81 indicating the pressure of gas in supply line 75 and, consequently, the pressure of gas in the pneumatic cylinder 76. Introduction of gas under pressure through the line 75 by opening valve 72 causes the plunger 82 of the cylinder 76 to retract. Such plunger is connected to the outhaul 9 as described in more detail below.

With reference to FIGS. 7 and 8, the second pneumatic jack 76 is mounted inside the aft end portion of the boom 5. A mounting cup 85 can be bolted to the rear or plunger end portion of the cylinder 76 and have one or more retractable pins 86 extending through holes in the mast end portion to rigidly but removably secure the cylinder 76 in position. The retractable plunger of such cylinder extends aftward inside the hollow boom and carries a clevis 87 for connection of one end of the outhaul 9. From such clevis, the outhaul is routed around a lower sheave 88 rotatable on the central upright pin 89 connecting the opposite side sections of the boom 5 together. From sheave 88, the outhaul extends forward and around a pin 90 carried at one side of the clew 8 of the sail and back rearward to an upper sheave 91 rotatable on pin 89 above the lower sheave 88. From such upper sheave 91, the outhaul extends forward around a pin at the opposite side of the clew 8 and back rearward to a conventional cleat or clinch 92 where the free end portion 93 of the outhaul is secured.

During the rigging of the outhaul 9 as described above, preferably it is given its preliminary tensioning adjustment with the plunger 82 of jack 76 in approximately a central position Subsequently, while under sail, the user can manipulate the valve levers 79 and 80 to cause the plunger 82 to retract to tighten the downhaul or extend to loosen the downhaul. In addition, to achieve a desired shape of the sail airfoil the valve levers 64 and 65 of the front valve assembly 56 can be manipulated as desired for increasing and decreasing the downhaul tension.

FIG. 10 shows a further modification of downhaul tensioning mechanism which uses a different type of fluid pressure member in the form of an extensible bellows 100. Much of the construction is similar to the downhaul tensioning mechanism described previously, including the foot 3 with its mast-mounting tube 14 over which the intermediate mast-height adjusting tube 20 slides. The long upper portion 4 of the mast is telescoped down over the intermediate tube 20 and rests on the collar 24 which, in turn, is supported on the diametral pin 23. A mounting disk 101 is secured to the top of the mast-mounting tube 14 and the extensible bellows fluid pressure member 100 is engaged between such disk 101 and pin 23. The reciprocating or upper end portion 102 of such fluid pressure member 100 is moved upward to raise the top mast tube 4 by introduction of gas under pressure through the supply line 25. The gas supply and gas-releasing valve mechanism can be the same as previously described with reference to the embodiment of the invention shown in FIGS. 6 through 9.

I claim:

1. In a sailboard construction including a board for supporting a user, a vertically elongated mast member supported on the board, a horizontally elongated boom member supported on the mast member, a generally triangular sail having a head, a tack and a clew, means connecting the head of the sail to the top of the mast, the tack of the sail to generally the foot of the mast and the clew of the sail to the boom so as to tension the sail, the improvement comprising a fluid pressure member supported on but separate from one of the elongated members, said fluid pressure member having a portion reciprocable by introduction of fluid into and release of fluid from said fluid pressure member, said reciprocable portion being connected so that reciprocation thereof is effective to adjust the sail tension, and manually manipulable control means for introducing fluid into and releasing fluid from said fluid pressure member, said control means being mounted for access by the user while under sail to reciprocate said reciprocable portion and thereby adjust the sail tension.

2. In the construction defined in claim 1, means for indicating to the user while under sail the pressure of fluid in the fluid pressure member.

3. In the construction defined in claim 1, the elongated member on which the fluid pressure member is supported having respective telescoping portions, the fluid pressure member including a fluid pressure jack secured on one of said telescoping portions and having a reciprocable plunger connected to the other of such telescoping portions.

4. In the construction defined in claim 1, the means for connecting the sail to the mast and boom members including a haul line and the reciprocable portion of the fluid pressure member being connected directly to said line.

5. In the construction defined in claim 1, the control means including a manually operated pump for supplying fluid under pressure to the fluid pressure member.

6. In the construction defined in claim 5, the pump being mounted on the boom member.

7. In the construction defined in claim 6, the pump being mounted inside the boom member.

8. In a sailboard construction including a board for supporting a user, a vertically elongated mast member mounted on the board, a horizontally elongated boom member supported on the mast member, a generally triangular sail having a head, a tack and a clew, means for connecting the head of the sail to the top of the mast, the tack of the sail to generally the foot of the mast and the clew of the sail to the boom so as to tension the sail, such mast member including a foot portion supported on the board and an upper portion telescoped over the foot portion and movable relative thereto, the improvement comprising a fluid pressure member connected between the mast foot and upper portions, said fluid pressure member including a reciprocable portion extendible and retractable to effect movement of the two mast portions relative to each other and thereby adjust the effective length of the mast, and control means for supplying fluid to and releasing fluid from said fluid pressure member so as to cause its reciprocable portion to reciprocate.

9. In the construction defined in claim 8, the control means including operating means manually manipulable by the user while under sail to reciprocate the reciprocable portion of the fluid pressure member and thereby adjust the effective length of the mast for adjusting the tension of the sail.

10. In a sailboard construction including a board for supporting a user, a vertically elongated mast member supported on the board, a horizontally elongated boom member supported on the mast member, a generally triangular sail having a head, a tack and a clew, means for connecting the head of the sail to the top of the mast, means for connecting the tack of the sail to generally the foot of the mast and an outhaul for connecting the clew of the sail to the boom, the improvement comprising a fluid pressure member supported on the boom and having a portion reciprocable relative to the boom by introduction of fluid into said fluid pressure member and release of fluid from said pressure member, said reciprocable portion of said fluid pressure member being connected to the outhaul, and control means for introducing fluid into and releasing fluid from said fluid pressure member so as to reciprocate its reciprocable portion and thereby adjust the outhaul tension.

11. In the construction defined in claim 10, the control means including operating means manually manipulable by the user while under sail to reciprocate the reciprocable portion of the fluid pressure member.

12. In the construction defined in claim 10, the fluid pressure member being mounted inside the boom.

13. The method of adjusting the tension of the downhaul of the sail of a sailboard having a mast including foot and upper portions movable relative to each other, said sail having a head connected to the mast upper portion and a tack connected to the mast foot portion by the downhaul, which method comprises supplying fluid under pressure to a fluid pressure member having a portion mechanically connected to one mast portion and a reciprocable portion mechanically connected to the other mast portion so as to cause said reciprocable portion to move in a direction to increase or decrease the effective height of the mast and thereby increase or decrease the downhaul tension.

* * * * *